US011486398B2

(12) United States Patent
Jung et al.

(10) Patent No.: US 11,486,398 B2
(45) Date of Patent: Nov. 1, 2022

(54) ROTARY COMPRESSOR WITH SELECTIVE OIL COMMUNICATION

(71) Applicant: LG Electronics Inc., Seoul (KR)

(72) Inventors: Sungwon Jung, Seoul (KR); Ji Hoon Kim, Seoul (KR); Heehyun Park, Seoul (KR); Yoonjae Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 16/921,087

(22) Filed: Jul. 6, 2020

(65) Prior Publication Data

US 2021/0017993 A1 Jan. 21, 2021

(30) Foreign Application Priority Data

Jul. 17, 2019 (KR) ..... 10-2019-0086563

(51) Int. Cl.
*F04C 29/02* (2006.01)
*F04C 18/324* (2006.01)
*F01C 21/08* (2006.01)

(52) U.S. Cl.
CPC ..... *F04C 29/02* (2013.01); *F01C 21/0809* (2013.01); *F04C 18/324* (2013.01); *F04C 29/028* (2013.01)

(58) Field of Classification Search
CPC ..... F04C 18/324; F04C 29/02; F04C 29/028; F01C 21/0809
See application file for complete search history.

(56) References Cited

U.S. PATENT DOCUMENTS 4,640,669 A * 2/1987 Gannaway ..... F04C 23/008 184/6.16
7,438,541 B2 * 10/2008 Aya ..... F04C 23/008 418/94
2012/0260691 A1 10/2012 Hirayama

FOREIGN PATENT DOCUMENTS

| | | |
|---|---|---|
| CN | 102227561 | 10/2011 |
| JP | S61106992 | 5/1986 |
| JP | H06257579 | 9/1994 |
| JP | H06264881 | 9/1994 |
| JP | H06346880 | 12/1994 |
| JP | 2006258001 | 9/2006 |
| WO | WO2010087180 | 8/2010 |

OTHER PUBLICATIONS

Machine Translation of Japanese Patent Publication—JP 61-106992A, Inventors: Kosokabe et al; Title: Rotary Compressor, original publication—May 24, 1986. (Year: 1986).*
Extended European Search Report in European Appln. No. 20178305.7, dated Oct. 30, 2020, 8 pages.
Korean Office Action in Korean Appln. No. 10-2019-0096563, dated Sep. 14, 2020, 15 pages (with English translation).

* cited by examiner

*Primary Examiner* — Mary Davis
(74) *Attorney, Agent, or Firm* — Fish & Richardson P.C.

(57) ABSTRACT

A rotary compressor is disclosed. The rotary compressor includes a sidewall path formed in an inner wall of a cylinder facing a vane slot and configured to form a space facing a side surface of a vane, and the vane is provided with a communication part configured to selectively communicate between the outside of the vane slot and the sidewall path according to a position of the vane.

11 Claims, 17 Drawing Sheets

ROTARY COMPRESSOR WITH SELECTIVE OIL COMMUNICATION

CROSS-REFERENCE TO RELATED APPLICATION

This application claims priority to and the benefit of Korean Patent Application No. 2019-0086563, filed on Jul. 17, 2019, the disclosure of which is incorporated herein by reference in its entirety.

TECHNICAL FIELD

The present disclosure relates to a compressor, and more specifically, to a rotary compressor.

BACKGROUND

Generally, a compressor refers to an apparatus which compresses a refrigerant. Compressors can be classified into a reciprocating type, a centrifugal type, a vane type, and a scroll type.

Among the above, a rotary compressor is a compressor using a method of compressing a refrigerant using a roller (also referred to as a "rolling piston") and a vane. In the rotary compressor, a roller eccentrically rotates in a compression space of a cylinder. Further, the vane comes into contact with an outer circumferential surface of the roller to partition the compression space of the cylinder into a suction chamber and a discharge chamber.

According to the above-described rotary compressor, since the roller revolves in the cylinder, the vane inserted into and mounted in the cylinder moves linearly. Accordingly, a compression chamber of which a volume is variable is formed in each of the suction chamber and the discharge chamber formed in the cylinder, and thus suction, compression, and discharge of the refrigerant are performed.

In the conventional rotary compressor having the above-described configuration, there is a problem in that the refrigerant leaks between the roller and the vane and thus the performance of the compressor is degraded.

Recently, in order to solve leakage between the roller and the vane, a rotary compressor having a combined vane-roller structure, which is a structure in which the vane is inserted into and combined with the roller, is introduced.

FIG. 1 is a cross-sectional view illustrating an example of a rotary compressor having the conventional combined vane-roller structure.

Referring to FIG. 1, in the rotary compressor having the conventional combined vane-roller structure, one end of a vane 4 is coupled to an inserting portion 2*a* formed on the outer circumferential surface of a roller 2, and the other end of the vane 4 is inserted into a vane slot 3 formed in a cylinder 1.

The vane 4 linearly moves along a path formed in the vane slot 3 due to movement of the roller 2 which revolves in the cylinder 1. The roller 2 does not reciprocate but revolves in the cylinder 1. Accordingly, it is difficult for a force transferred to the vane 4 by the roller 2 to act in the same direction as a direction in which the vane 4 linearly moves. That is, the roller 2 transfers a force which acts in a direction biased to a circumferential direction of the cylinder 1 from the direction in which the vane 4 linearly moves to the vane 4.

Accordingly, the vane 4 receives the force biased to the circumferential direction and linearly moves on the vane slot 3. Accordingly, the vane 4 presses an inner wall of the vane slot 3 while linearly moving. Accordingly, a frictional resistance between the vane 4 and the inner wall of the vane slot 3 increases, and thus, since sliding loss is generated, the vane 4 and the inner wall of the vane slot 3 can become worn.

(Patent Document 1) Chinese Laid-Open Patent No. 102227561 (Published on Oct. 26, 2011)

SUMMARY

The present disclosure is directed to providing a rotary compressor of which a structure is improved so that thermal expansion of a vane is suppressed.

Further, the present disclosure is directed to providing a rotary compressor of which a structure is improved so that the lifespan of each of a vane and a cylinder increases.

In addition, the present disclosure is directed to providing a rotary compressor provided with a vane which is easily processed, has high-strength, and has an efficient cooling structure.

In a rotary compressor which is one embodiment of the present disclosure, a communication part is provided that is linked with a position change of a vane to selectively communicate between a path in a vane slot and a space filled with oil or between a compression space and the space filled with the oil.

Further, the present disclosure may further include a sidewall path formed in an inner wall of the cylinder facing the vane slot and configured to form a space facing a side surface of the vane.

The sidewall path may be concavely formed in the inner wall of the cylinder.

Further, the sidewall path may be formed to pass through the cylinder in an axial direction.

In addition, in another embodiment of the present disclosure, a sidewall path is formed in an inner wall of a cylinder facing a vane inserted into a vane slot, a first oil supply path is formed at an outer side of the vane slot in a radial direction to pass through a cylinder in a radial direction, and an open hole is formed to pass through the vane.

A position of the open hole is changed when the vane moves, and when at least a portion of the open hole is located at a position overlapping the sidewall path, the first oil supply path and the sidewall path may communicate with each other through the open hole. In this case, oil introduced into the first oil supply path may be introduced into the sidewall path through the open hole to come into contact with a side portion of the vane and heat-exchanged with the vane to cool the vane.

Further, in still another embodiment of the present disclosure, an oil supply groove may be formed in a vane, and oil at the outside of a cylinder may be supplied to a sidewall path through the oil supply groove.

In addition, in yet another embodiment of the present disclosure, an oil supply groove may be formed in a vane, and oil at the outside of a cylinder may be introduced to a compression space in the cylinder through the oil supply groove.

The oil carried through the oil supply groove may be supplied to a bearing configured to cover one side of the cylinder in an axial direction.

Particular implementations described herein provide a rotary compressor that includes a cylinder, a roller, a vane, and a vane slot. The cylinder may include a compression space. The roller may be configured to compress a refrigerant in the cylinder. The vane may be engaged with the roller. The vane slot may be defined at the cylinder. The vane may be at least partially inserted into the vane slot and linearly movable along the vane slot. The vane may include a communication part configured to, based on a position of the vane relative to the vane slot, selectively permit fluidic communication between (1) the vane slot and an oil space that receives oil or (2) between the compression space and the oil space.

In some implementations, the rotary compressor described herein can optionally include one or more of the following features. The rotary compressor may include a sidewall path defined at an inner wall of the cylinder that faces the vane slot. The sidewall path may face a surface of the vane that is inserted into the vane slot. The communication part may selectively permit fluidic communication between the oil space and the sidewall path. The cylinder may include a first oil supply path configured to fluidly communicate with the oil space. The first oil supply path may extend through the cylinder and fluidly communicates with the vane slot in the cylinder. The sidewall path may be recessed at the inner wall of the cylinder so that a space is defined between the vane and the inner wall of the cylinder that faces the vane. The sidewall path may extend in an axial direction. The sidewall path may extend through the cylinder in an axial direction. The rotary compressor may include a first member that covers a first side of the cylinder in the axial direction, and a second member that covers a second side of the cylinder that is opposite to the first side in the axial direction. The sidewall path may overlap with the first member and the second member in the axial direction. The first member may include a first bearing that covers the first side of the cylinder. The second member may include a second bearing or a middle plate that covers the second side of the cylinder. The first member may include a middle plate that covers the first side of the cylinder. The second member may include a second bearing that covers the second side of the cylinder. The vane may have a proximal end and a distal end opposite to the proximal end in a radial direction. The vane may have opposite sides extending between the proximal end and the distal end. The communication part may include a hole that extends through the vane between the opposite sides of the vane and extends from the distal end of the vane toward the proximal end of the vane in the radial direction. The hole may be open toward the inner wall of the cylinder that faces the vane. The communication part may fluidly communicate with the sidewall path and the vane slot based on the vane being located at a first position in which the hole overlaps the sidewall path and the vane slot. The communication part may block the sidewall path from the vane slot based on the vane being located at a second position in which the hole is spaced apart from the sidewall path. The cylinder may include a second oil supply path that fluidly communicates with the first oil supply path. The second oil supply path may be defined at the vane slot and extend from the first oil supply path in a centripetal direction. The second oil supply path and the first oil supply path may be separated by the vane slot. The communication part may fluidly communicate with the sidewall path and the second oil supply path based on the vane being located at the first position. The communication part may block the sidewall path from the second oil supply path based on the vane being located at the second position. The roller may be configured to revolve between a first roller position and a second roller position. The second roller position may be closer to the vane slot than the first roller position. The vane may be configured to linearly move in the vane slot based on revolution of the roller. The vane may be disposed at the first position based on the roller being located at a position that is closer to the first roller position than the second roller position. The vane may be disposed at the second position based on the roller being located at a position that is closer to the second roller position than the first roller position. The communication part may include an oil supply groove defined at the vane. The oil supply groove may extend in a direction that the vane moves along the vane slot. The rotary compressor may include a sidewall path defined at an inner wall of the cylinder that faces the vane slot. The sidewall path may face a surface of the vane that is inserted into the vane slot, a first member that covers a first side of the cylinder in an axial direction, a second member that covers a second side of the cylinder that is opposite to the first side in the axial direction. The sidewall path may overlap with the first member and the second member in the axial direction. The oil supply groove and the sidewall path may be configured to fluidly communicate with each other based on the vane being located at a first position in which the oil supply groove is located within a periphery of each of the first member and the second member. The oil supply groove and the sidewall path may be configured to be fluidly separated from each other based on the vane being located at a second position in which the oil supply groove is located to at least partially extend beyond the periphery of each of the first member and the second member. The roller may be configured to revolve between a first roller position and a second roller position. The second roller position may be closer to the vane slot than the first roller position. The vane may be configured to linearly move in the vane slot based on revolution of the roller. The vane may be disposed at the first position based on the roller being located at a position that is closer to the first roller position than the second roller position. The vane may be disposed at the second position based on the roller being located at a position that is closer to the second roller position than the first roller position. The oil supply groove may include a first groove portion and a second groove. The first groove may be defined at a surface of the vane that faces the first member, and extend along a first direction that the vane moves along the vane slot. The second groove portion may be defined at the surface of the vane and extend from the first groove portion in a second direction perpendicular to the first direction. The second groove portion may be open toward an inner wall of the vane slot. The vane may be configured to define a suction chamber and a compression chamber in the compression space.

According to an aspect of the present disclosure, there is provided a rotary compressor including: a cylinder including a compression space; a ring-shaped roller configured to compress a refrigerant in the cylinder; a vane having one side coupled to the roller and configured to divide a suction space and a compression space in the compression space; a vane slot formed to pass through the cylinder in the radial direction, and into which the vane is inserted to be linearly movable; and a sidewall path formed in an inner wall of the cylinder facing the vane slot and configured to form a space facing a side surface of the vane, wherein the vane is provided with a communication part configured to selectively communicate between the outside of the vane slot and the sidewall path according to a position of the vane.

Further, the cylinder may be provided with a first oil supply path, and the first oil supply path may be formed to pass through the cylinder and may communicate with the vane slot in the cylinder.

The sidewall path may be concavely formed in the inner wall of the cylinder so that a separation space is formed between the vane and the inner wall of the cylinder facing the vane.

Further, the sidewall path may be formed to extend in an axial direction.

In addition, the sidewall path may be formed to pass through the cylinder in the axial direction.

In addition, the rotary compressor may further include a first member configured to cover one side of the cylinder in the axial direction, and a second member configured to cover the other side of the cylinder in the axial direction, and the sidewall path may be disposed at a position overlapping the first member and the second member in the axial direction.

In addition, the first member may be a first bearing configured to cover the one side of the cylinder in the axial direction, and the second member may be a second bearing or middle plate configured to cover the other side of the cylinder in the axial direction.

In addition, the first member may be a middle plate configured to cover the one side of the cylinder, and the second member may be a second bearing configured to cover the other side of the cylinder.

In addition, the communication part may include an open hole which is formed to pass through the vane and extends from the other side end portion of the vane toward one side of the vane, and the open hole may be open toward the inner wall of the cylinder facing the vane.

In addition, the communication part may communicate between the sidewall path and the vane slot when the open hole is located at a first position overlapping the sidewall path and the vane slot in the circumferential direction, and the communication part may block a space between the sidewall path and the vane slot when the open hole is located at a second position not overlapping the sidewall path in the circumferential direction.

In addition, the cylinder may be further provided with a second oil supply path which communicates with the first oil supply path, the second oil supply path may be concavely formed in the vane slot to extend from the first oil supply path in a centripetal direction, and the second oil supply path and the first oil supply path may be separated by the vane slot.

In addition, the communication part may communicate between the sidewall path and the second oil supply path when the open hole is located at the first position overlapping the sidewall path and the vane slot in the circumferential direction, and the communication part may block a space between the sidewall path and the second oil supply path when the open hole is located at the second position not overlapping the sidewall path in the circumferential direction.

In addition, the roller may revolve between a first point which is a point farthest away from the vane slot and a second point which is a point closest to the vane slot, the vane may linearly move in the vane slot in conjunction with revolution of the roller, the open hole may be disposed at the first position when the roller is located at a position further biased to the first point, and the open hole may be disposed at the second position when the roller is located at a position further biased to the second point.

In addition, the communication part may include an oil supply groove concavely formed in the vane, and the oil supply groove may be formed to a length which extends in a moving direction of the vane.

In addition, the rotary compressor may further include a first member configured to cover one side of the cylinder in the axial direction, and a second member configured to cover the other side of the cylinder in the axial direction, wherein the sidewall path may be disposed at a position overlapping the first member and the second member in the axial direction.

In addition, the oil supply groove and the sidewall path may communicate with each other when the oil supply groove is located at a first position, the oil supply groove and the sidewall path may be separated from each other when the oil supply groove is located at a second position, the first position may be a position where the oil supply groove is entirely disposed at an inner side in a circumferential direction of each of the first member and the second member, and the second position may be a position where the oil supply groove is at least partially exposed to an outer side in the circumferential direction of each of the first member and the second member In addition, the roller may revolve between a first point which is a point farthest away from the vane slot and a second point which is a point closest to the vane slot, the vane may linearly move in the vane slot in conjunction with revolution of the roller, the oil supply groove may be disposed at the first position when the roller is located at a position further biased to the first point, and the oil supply groove may be disposed at the second position when the roller is located at a position further biased to the second point.

In addition, the oil supply groove may include a first groove portion which is concavely formed in an upper surface of the vane facing the first member and extends along a moving direction of the vane, and a second groove portion, which is concavely formed in the upper surface of the vane facing the first member, extends from the first groove portion in the circumferential direction, and is open toward an inner wall of the vane slot.

In addition, when the oil supply groove is located at the first position, the first groove portion may be disposed at an inner side in a circumferential direction of each of the first member and the second member.

In addition, when the oil supply groove is located at the first position, the second groove portion may communicate with the sidewall path.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
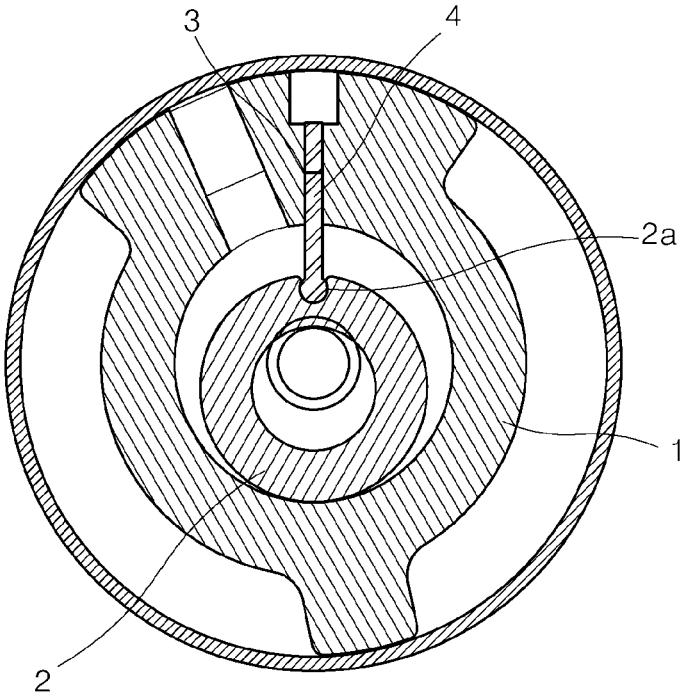
FIG. 1 PRIOR ART
FIG. 1 is a cross-sectional view illustrating an example of a rotary compressor having a conventional combined vane-roller structure.

Hereinafter, embodiments of a rotary compressor according to the present disclosure will be described with reference to the accompanying drawings. Thicknesses of lines, sizes of components, or the like shown in the drawings may be shown to be exaggerated for clarity and convenience of description. Further, terms which will be described later are terms defined in consideration of functions in the present disclosure and may be a variety according to purposes or conventions of an operator or a user. Accordingly, the terms should be defined on the basis of the content throughout the specification.

[Overall Structure of Rotary Compressor]

Figure 2:
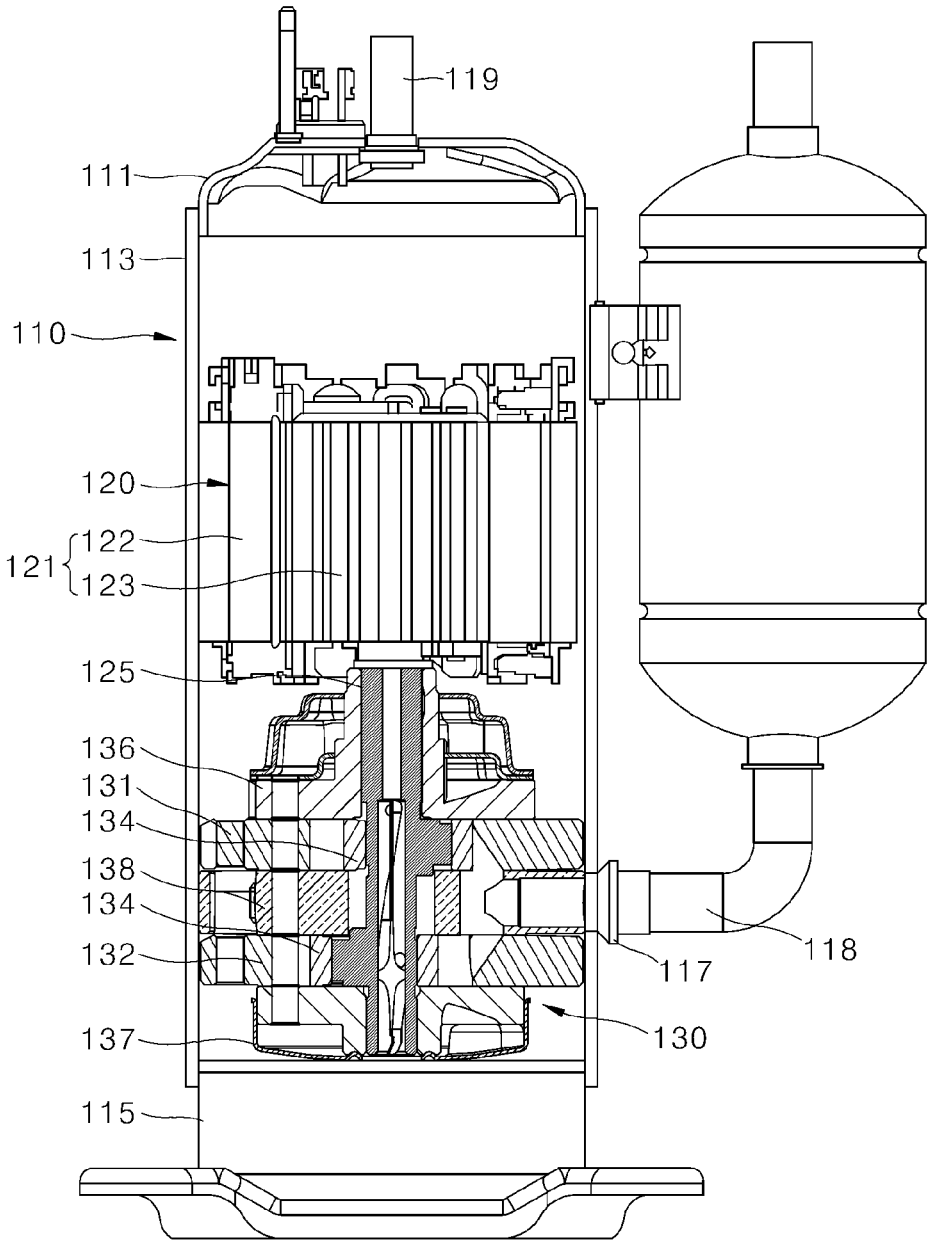
FIG. 2 is a cross-sectional view schematically illustrating a structure of a rotary compressor according to a first embodiment of the present disclosure.
Figure 3:
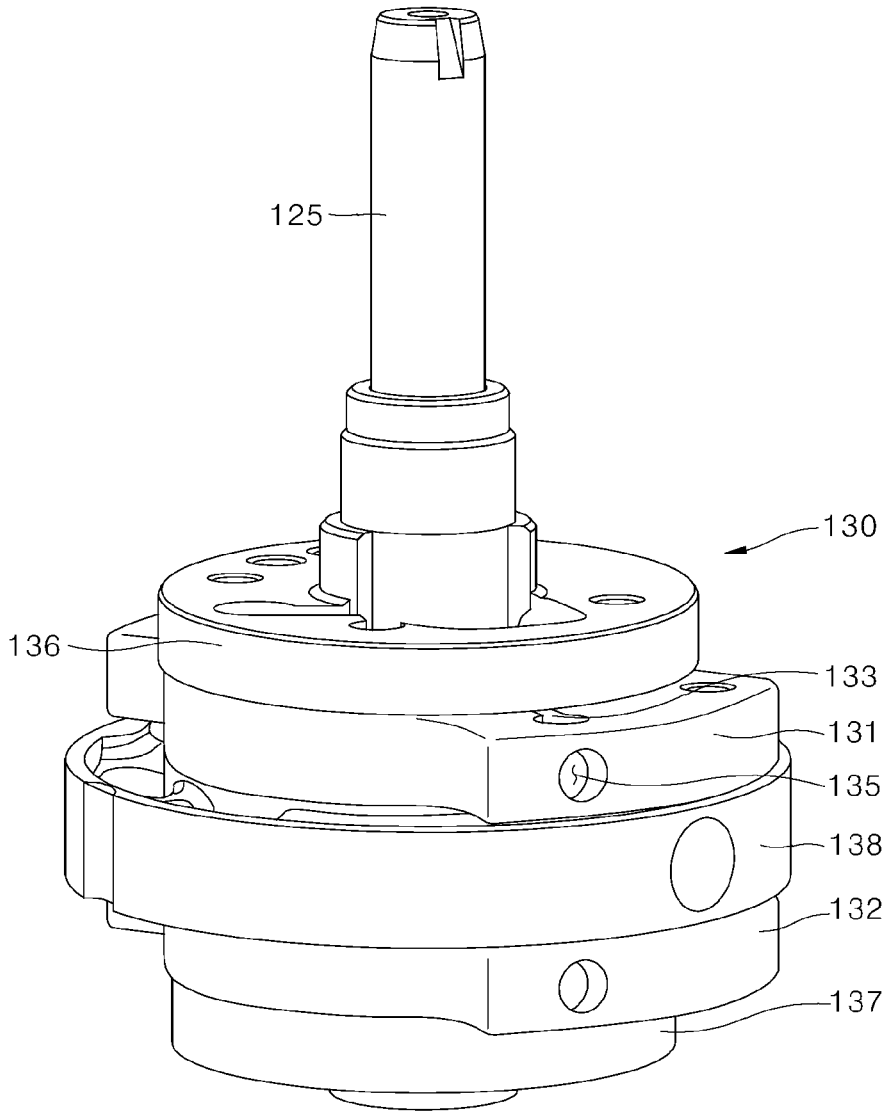
FIG. 3 is a perspective view illustrating some components of the rotary compressor shown in FIG. 2 in a separated state.

FIG. 2 is a cross-sectional view schematically illustrating a structure of a rotary compressor according to a first embodiment of the present disclosure, and FIG. 3 is a perspective view illustrating some components of the rotary compressor shown in FIG. 2 in a separated state.

Referring to FIG. 2, the rotary compressor according to the first embodiment of the present disclosure may include a case 110, a driving part 120, and a compression part 130.

The case 110 forms an exterior of the rotary compressor. In the case 110, an inner space which accommodates the driving part 120 and the compression part 130 may be formed. As an example, the case 110 may be formed in a cylindrical shape having a length extending along an axial direction.

The case 110 may include an upper shell 111, a middle shell 113, and a lower shell 115. The driving part 120 and the compression part 130 may be fixed to the inside of the middle shell 113. Further, the upper shell 111 and the lower shell 115 may be respectively disposed on and under the middle shell 113. The upper shell 111 and the lower shell 115 restrict exposure of components disposed in the case 110.

The driving part 120 may be accommodated in the inner space of the case 110 and disposed on the compression part 130. The driving part 120 serves to provide power for compressing a refrigerant and may include a motor 121 and a driving shaft 125.

The motor 121 may include a stator 122 and a rotor 123. The stator 122 may be fixed to the inside of the case 110 and, more specifically, to the inside of the middle shell 113. The rotor 123 may be disposed to be spaced apart from the stator 122 and may be disposed at an inner side of a radial direction of the stator 122.

When power is applied to the stator 122, the rotor 123 rotates due to a force generated by a magnetic field formed between the stator 122 and the rotor 123. As described above, the rotating rotor 123 transfers a rotational force to the driving shaft 125 passing through a center of the rotor 123.

The driving shaft 125 is rotated by the rotor 123 and may be connected to a roller 134 of the compression part 130 which will be described later. The driving shaft 125 may provide power for compressing the refrigerant by providing power required for revolution of the roller 134 to the roller 134.

Further, a suction port 117 may be provided at one side of the middle shell 113, and a discharge pipe 119 may be connected to one side of the upper shell 111. The suction port 117 may be connected to a suction pipe 118 connected to an evaporator, and the discharge pipe 119 may be connected to a condenser.

Referring to FIGS. 2 and 3, the compression part 130 may include cylinders 131 and 132, a first bearing 136, a second bearing 137, the roller 134, and a vane 135.

Each of the cylinders 131 and 132 is formed in a ring shape. In each of the cylinders 131 and 132, a compression space in which the refrigerant is compressed may be formed. The inside of each of the cylinders 131 and 132 may be formed to pass through in an axial direction.

In the embodiment, an example in which the compression part 130 includes two cylinders 131 and 132 is described. Accordingly, the compression part 130 may include a first cylinder 131 and a second cylinder 132. The first cylinder 131 and the second cylinder 132 may be arranged in the axial direction. That is, the first cylinder 131 is disposed at one side in the axial direction of the second cylinder 132 (hereinafter, referred to as "an upper side"), and the second cylinder 132 is disposed at the other side in the axial direction of the first cylinder 131 (hereinafter, referred to as "a lower side").

The first bearing 136 may be disposed on the first cylinder 131, and the second cylinder 132 may be disposed under the first cylinder 131. In this case, a middle plate 138 may be disposed between the first cylinder 131 and the second cylinder 132.

Further, the middle plate 138 may be disposed on the second cylinder 132, and the second bearing 137 may be disposed under the second cylinder 132.

The first bearing 136 and the second bearing 137 are respectively disposed on the first cylinder 131 and under the second cylinder 132, and the driving shaft 125 which passes through the first cylinder 131 and the second cylinder 132 may be rotatably supported. Further, the middle plate 138 is disposed between the first cylinder 131 and the second cylinder 132 to partition a space in the first cylinder 131 and a space in the second cylinder 132.

An upper portion of the space formed in the first cylinder 131 may be sealed by the first bearing 136, and a lower portion of the space formed in the first cylinder 131 may be sealed by the middle plate 138. As described above, the compression space may be formed in the first cylinder 131 sealed by the first bearing 136 and the middle plate 138.

Further, an upper portion of the space formed in the second cylinder 132 may be sealed by the middle plate 138, and a lower portion of the space formed in the second cylinder 132 may be sealed by the second bearing 137. As described above, the compression space may be formed in the second cylinder 132 sealed by the middle plate 138 and the second bearing 137.

The roller 134 and the vane 135 may be respectively disposed in the compression spaces of the cylinders 131 and 132.

The roller 134 may be coupled to the driving shaft 125 and rotatably coupled to an eccentric shaft 126 eccentrically protruding from the driving shaft 125. Specifically, the roller 134 may be formed in a ring shape, and the eccentric shaft 126 may be rotatably coupled to an inner circumferential surface of the roller 134. The roller 134 may revolve in the cylinders 131 and 132 while coming into contact with inner circumferential surfaces of the cylinders 131 and 132 when the driving shaft 125 rotates.

The vane 135 has one side coupled to the roller 134 and divides the compression space into a suction chamber S1 and a compression chamber S2. The vane 135 may be inserted into a vane slot 133 provided in each of the cylinders 131 and 132.

According to the embodiment, the vane slot 133 is formed to pass through each of the cylinders 131 and 132 in a radial direction and forms a straight path in each of the cylinders 131 and 132. The vane 135 is provided to be capable of reciprocating in a linear direction in the vane slots 133 formed as described above.

Further, a hinge head 1351 may be provided at one side of the vane 135, and the hinge head 1351 may be coupled to a roller groove 1341 provided in an outer circumferential surface of the roller 134. The hinge head 1351 is formed to protrude toward one side in the radial direction from the vane 135 and may be formed in a round shape.

Further, the roller groove 1341 may be formed in a round groove shape corresponding to a shape of the hinge head 1351. Since the hinge head 1351 is fit-coupled to the roller groove 1341, coupling of the roller 134 and the vane 135 may be maintained even during a revolving process of the roller 134.

In the embodiment, the vane 135 is illustrated as being formed of an SUJ2 steel material. The SUJ2 steel is steel widely used as bearing steel, and is a material which is easy to process and shape and has high impact resistance and high wear resistance. The SUJ2 steel is suitable as a material for manufacturing the vane 135 which should repeatedly move under a high pressure in the compression space.

In the compression part 130, with respect to the vane 135, the suction chamber S1 is located at a left portion of the vane 135, and the compression chamber S2 is located at a right portion of the vane 135. That is, the vane 135 may be coupled to the roller 134 to divide the compression space in each of the cylinders 131 and 132 into the suction chamber S1 and the compression chamber S2.

An intake (not shown) and a discharge port (not shown) may be respectively connected to the suction chamber S1 and the compression chamber S2 which are divided as described above. The refrigerant supplied through the suction port 117 may be introduced into the suction chamber S1 through the intake. Further, the refrigerant compressed in the compression chamber may be discharged to the outside of the compression part 130 through the discharge port and then discharged to the outside of the rotary compressor through the discharge pipe 119.

[Structure of Oil Supply Path]

Figure 4:
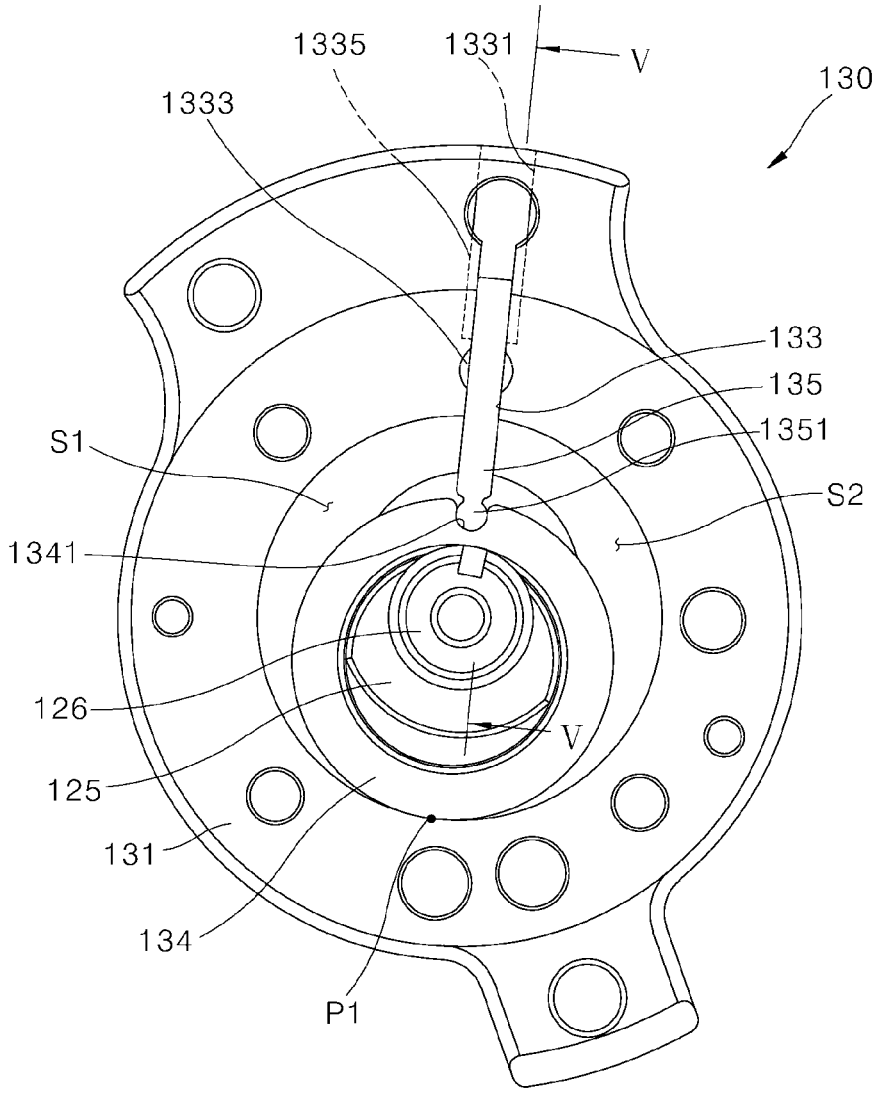
FIG. 4 is a plan view illustrating a state in which a first bearing is removed from the rotary compressor shown in FIG. 3.
Figure 5:
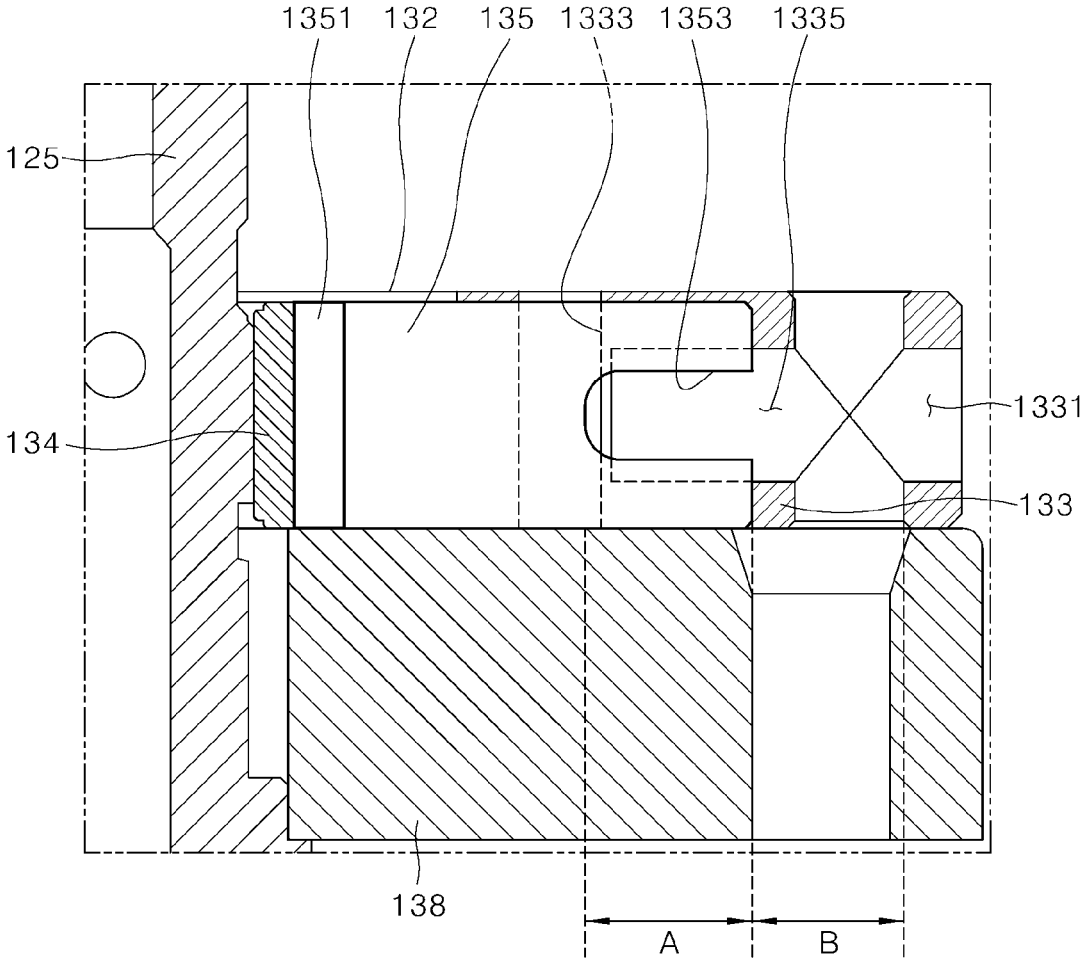
FIG. 5 is a cross-sectional view taken along line "V-V" in FIG. 4.

FIG. 4 is a plan view illustrating a state in which the first bearing is removed from the rotary compressor shown in FIG. 3, and FIG. 5 is a cross-sectional view taken along line "V-V" in FIG. 4.

Hereinafter, an oil supply structure to the vane in the vane slot will be described with reference to FIGS. 4 and 5. For convenience of description, here, the oil supply structure to the vane in the vane slot formed in the first cylinder will be representatively described.

However, it is noted that the structure exemplified in the embodiment may be applied to not only the first cylinder but also the second cylinder.

Referring to FIGS. 2 to 5, the first cylinder 131 may be provided with a first oil supply path 1331 and a sidewall path 1333.

The first oil supply path 1331 may be formed at the outside of the vane slot 133. The first oil supply path 1331 may be formed in a through hole shape disposed at an outer side of the vane slot 133 in a radial direction and passing through the first cylinder 131 in the radial direction.

One side of the first oil supply path 1331 formed as described above may pass through an outer circumferential surface of the first cylinder 131 to communicate with a space filled with oil at the outside of the vane slot 133. Further, the other side of the first oil supply path 1331 may communicate with the vane slot 133 in the first cylinder 131.

According to the embodiment, a lower region of the case 110 may be filled with oil. The oil may move in an upward direction through the driving shaft 125, be transferred to the compression part 130, and be introduced into the first cylinder 131 through the first oil supply path 1331.

The sidewall path 1333 may be formed in the first cylinder 131. The sidewall path 1333 may be formed in an inner wall of the first cylinder 131 facing the vane 135. Specifically, the sidewall path 1333 may be concavely formed in the inner wall of the first cylinder 131 so that a separation space is formed between the vane 135 and some of the inner wall of the first cylinder 131 facing the vane 135.

Further, the sidewall path 1333 may be formed to extend in an axial direction. In the embodiment, an example in which the sidewall path 1333 is formed to pass through the first cylinder 131 in the axial direction is described.

Further, a first member may be disposed at one side of the first cylinder 131 in the axial direction, that is, an upper side, and a second member may be disposed at the other side of the first cylinder 131 in the axial direction, that is, a lower side. The first member may cover an upper portion of the first cylinder 131, and the second member may cover a lower portion of the first cylinder 131. Further, the sidewall path 1333 is disposed at a position overlapping the first member and the second member in the axial direction.

Accordingly, the opened upper portion of the sidewall path 1333 is covered by the first member, and the opened lower portion of the sidewall path 1333 is covered by the second member. Accordingly, a space of which an upper portion is blocked by the first member and a lower portion is blocked by the second member may be formed in the sidewall path 1333.

According to the embodiment, the first member disposed at the one side in the axial direction of the first cylinder 131 may be the first bearing 136 which covers the upper portion of the first cylinder 131. Further, the second member disposed at the other side in the axial direction of the first cylinder 131 may be the middle plate 138 which covers the lower portion of the first cylinder 131.

As another example, with respect to the second cylinder 132 disposed under the first cylinder 131, the first member disposed at one side in the axial direction of the second cylinder 132 may be the middle plate 138 which covers the upper portion of the second cylinder 132. Further, the second member disposed at the other side in the axial direction of the second cylinder 132 may be the second bearing 137 which covers the lower portion of the second cylinder 132.

As still another example, when the compression part 130 is formed as one cylinder, the first member may be the first bearing 136 which covers the upper portion of the first cylinder 131 or second cylinder 132, and the second member may be the second bearing 137 which covers the lower portion of the first cylinder 131 or second cylinder 132.

The space of which the upper portion is blocked by the first member and the lower portion is blocked by the second member may be formed in the sidewall path 1333. Further, a space in the sidewall path 1333 formed in this way is opened toward the vane 135 inserted into the vane slot 133.

In addition, the first cylinder 131 may be further provided with a second oil supply path 1335. The second oil supply path 1335 may be formed in the first cylinder 131 and may be concavely formed in the inner wall of the first cylinder 131 facing the vane 135.

The second oil supply path 1335 may be disposed between the first oil supply path 1331 and the sidewall path 1333 in the radial direction and between an upper end and a lower end of the vane slot 133 in the axial direction. The second oil supply path 1335 may extend from the first oil supply path 1331 to the sidewall path 1333 in a centripetal direction. In this case, the second oil supply path 1335 may be directly connected to the first oil supply path 1331 but not directly connected to the sidewall path 1333.

According to the embodiment, the oil introduced into the first cylinder 131 through the first oil supply path 1331 may pass through the inside of the vane slot 133 through the second oil supply path 1335 and move toward the sidewall path 1333. Further, the oil which moves through the second oil supply path 1335 like the above may be introduced into the sidewall path 1333 through a path formed by a communication part which will be described later.

Like the above, the oil introduced into the sidewall path 1333 may come into contact with a side portion of the vane 135 inserted into the vane slot 133 to be heat-exchanged with the vane 135. That is, the vane 135 may be cooled by the oil introduced into the sidewall path 1333.

The sidewall path 1333 may not be directly connected to the first oil supply path 1331 and may be indirectly connected to the first oil supply path 1331 through the second oil supply path 1335 formed in the vane slot 133. That is, the oil introduced into the first oil supply path 1331 may be introduced into the sidewall path 1333 through the vane slot 133.

[Structure of Vane and Communication Part]

The vane 135 is inserted into the vane slot 133. That is, a space in the vane slot 133 is filled by the vane 135, and accordingly, the oil introduced into the first oil supply path 1331 may be introduced into the sidewall path 1333 when passing through the vane 135 inserted into the vane slot 133.

The vane 135 may be provided with the communication part to form a path so that the oil introduced into the first oil supply path 1331 may be introduced into the sidewall path 1333 through the vane slot 133. The communication part may perform a function of selectively communicating between the first oil supply path 1331 and the sidewall path 1333 and, more specifically, between the second oil supply path 1335 and the sidewall path 1333 according to a position of the vane 135.

In the embodiment, an example in which the communication part includes an open hole 1353 is described. The open hole 1353 may be formed to pass through the vane 135. The open hole 1353 may be formed to extend from the other side end portion to one side of the vane 135.

As an example, the open hole 1353 may be formed in a shape in which a portion of the vane 135 is incised in the centripetal direction from the other side end portion of the vane 135, that is, an outer end portion of the vane 135 in the radial direction. The open hole 1353 may be opened to an outer side of the vane 135 in the radial direction and opened toward the inner wall of the first cylinder 131 facing the vane 135.

A position of the open hole 1353 may be changed according to the position of the vane 135. That is, when the vane 135 moves in an escaping direction from the vane slot 133, that is, in the centripetal direction, the position of the open hole 1353 is also changed in the centripetal direction as much as a moving distance of the vane 135. Further, when the vane 135 moves in an insertion direction into the vane slot 133, that is, in a centrifugal direction, the position of the open hole 1353 is also changed in the centrifugal direction as much as a moving distance of the vane 135.

When the open hole 1353 is located at a first position A, the open hole 1353 is located at a position overlapping the sidewall path 1333 and the vane slot 133 in the circumferential direction and, more specifically, a position overlapping the sidewall path 1333 and the second oil supply path 1335 in the circumferential direction. In this case, the communication part may communicate between the sidewall path 1333 and the vane slot 133 and, more specifically, between the sidewall path 1333 and the second oil supply path 1335.

Further, when the open hole 1353 is located at a second position B, the open hole 1353 is located at a position not overlapping the sidewall path 1333 in the circumferential direction. In this case, the open hole 1353 communicates only with the vane slot 133 and the second oil supply path 1335 formed therein and does not communicate with the sidewall path 1333. In this case, the communication part blocks a space between the sidewall path 1333 and the vane slot 133, that is, a space between the sidewall path 1333 and the second oil supply path 1335.

Hereinafter, an action of the communication part will be described in more detail.

[Oil Supply Structure to Vane in Vane Slot]

Figure 6:
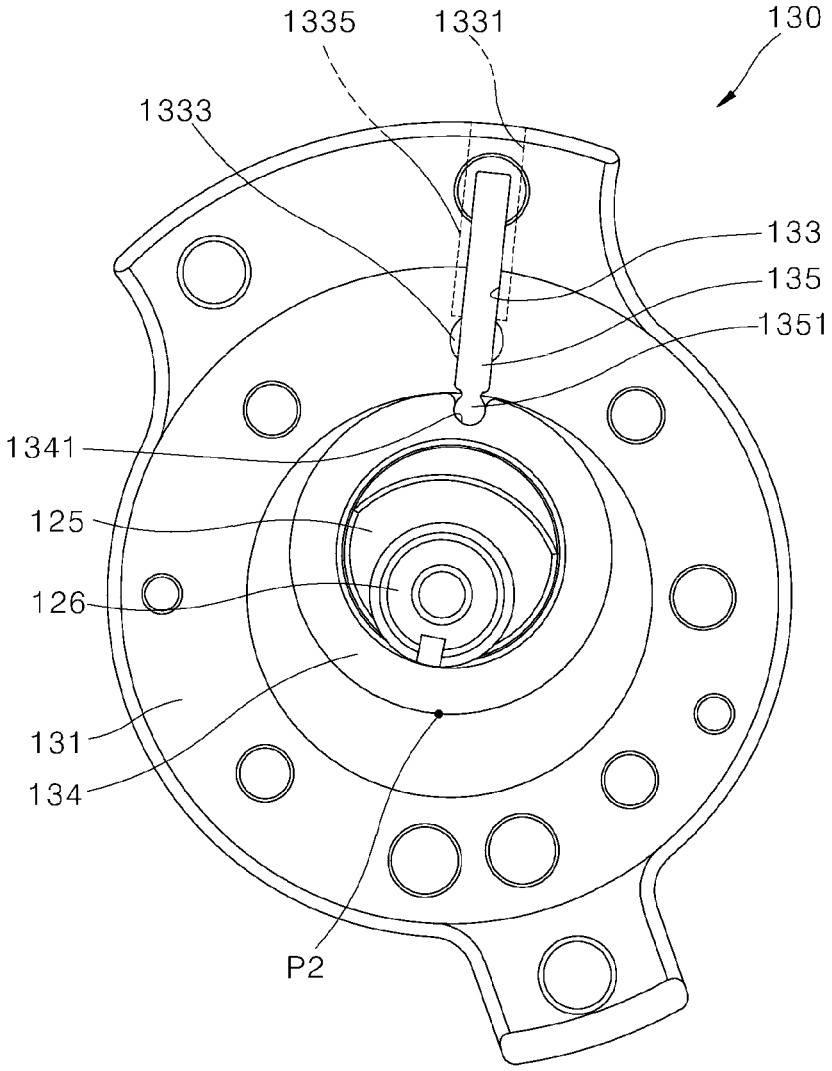
FIG. 6 is a horizontal-sectional view illustrating a position of each of a roller and a vane when the roller is located at a second point.
Figure 7:
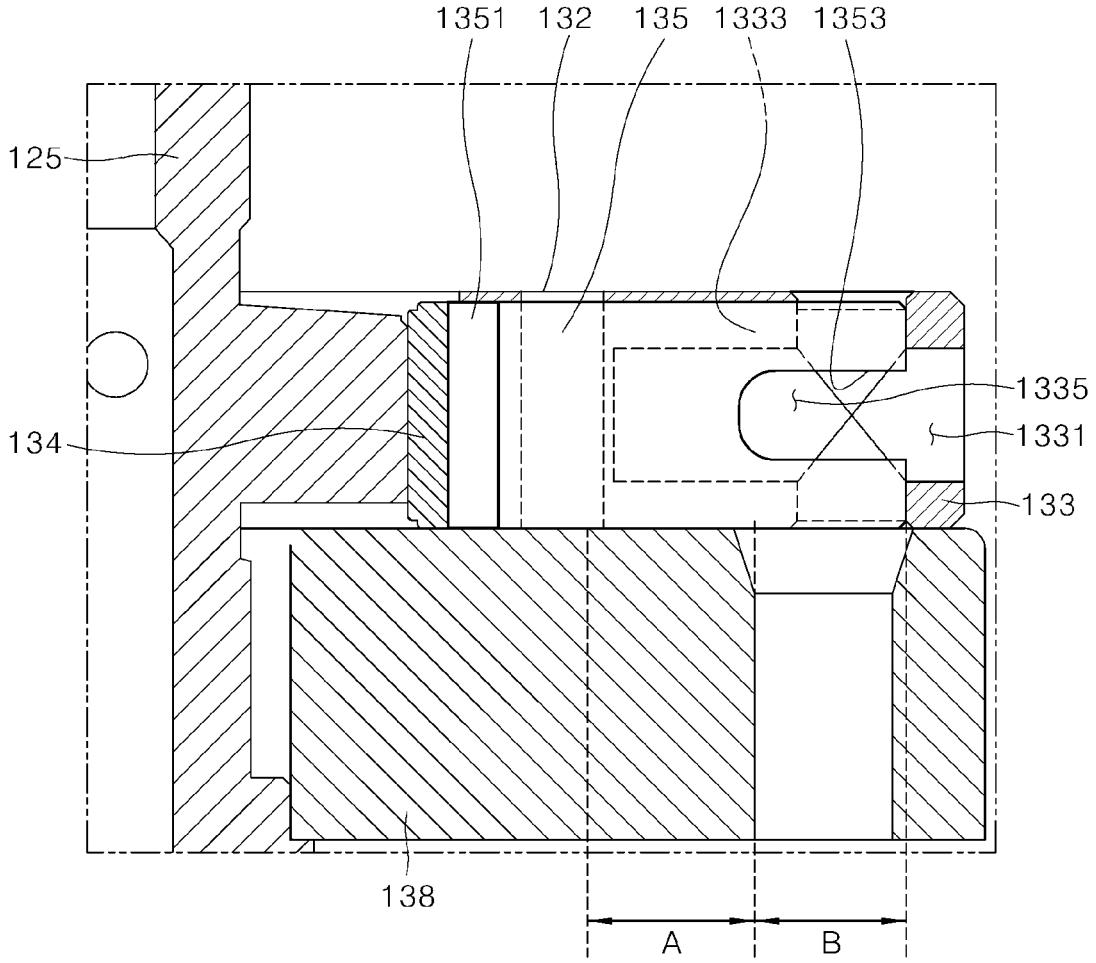
FIG. 7 is a side-sectional view illustrating the position of the vane when the roller is located at the second point.
Figure 8:
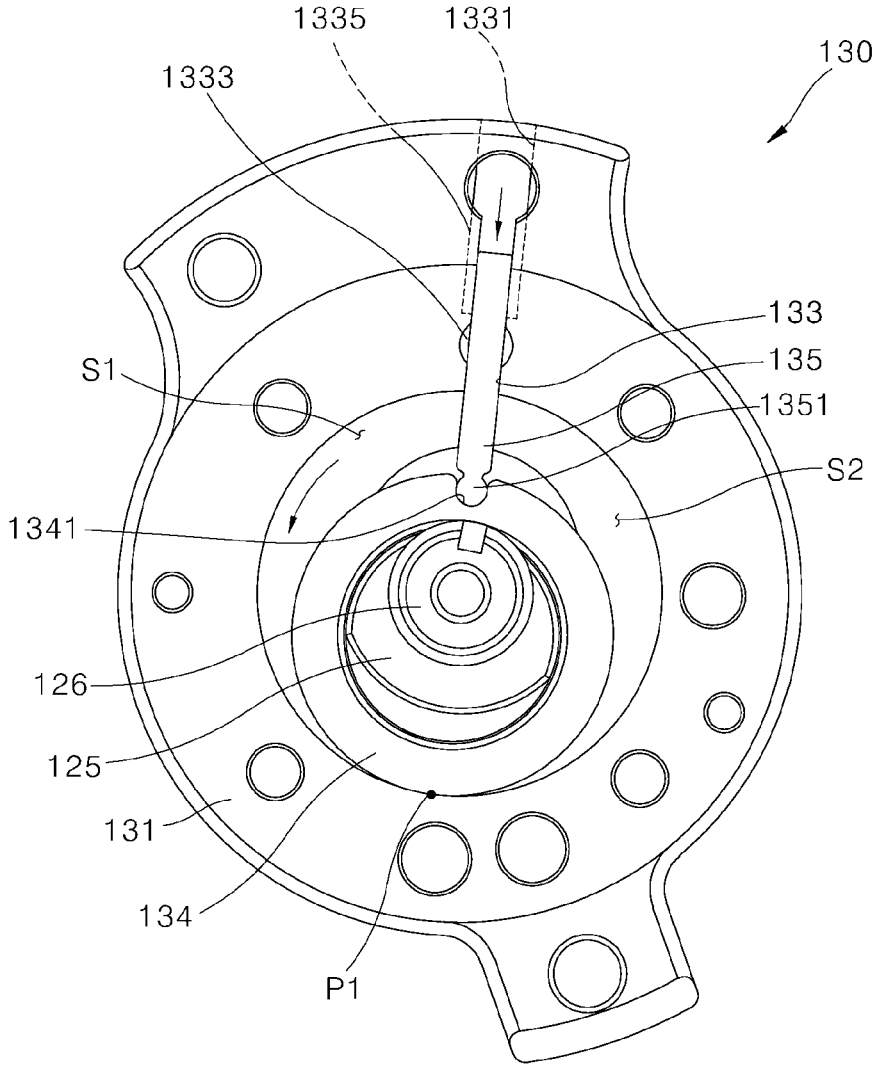
FIG. 8 is a horizontal-sectional view illustrating a position of each of the roller and the vane when the roller is located at a first point.
Figure 9:
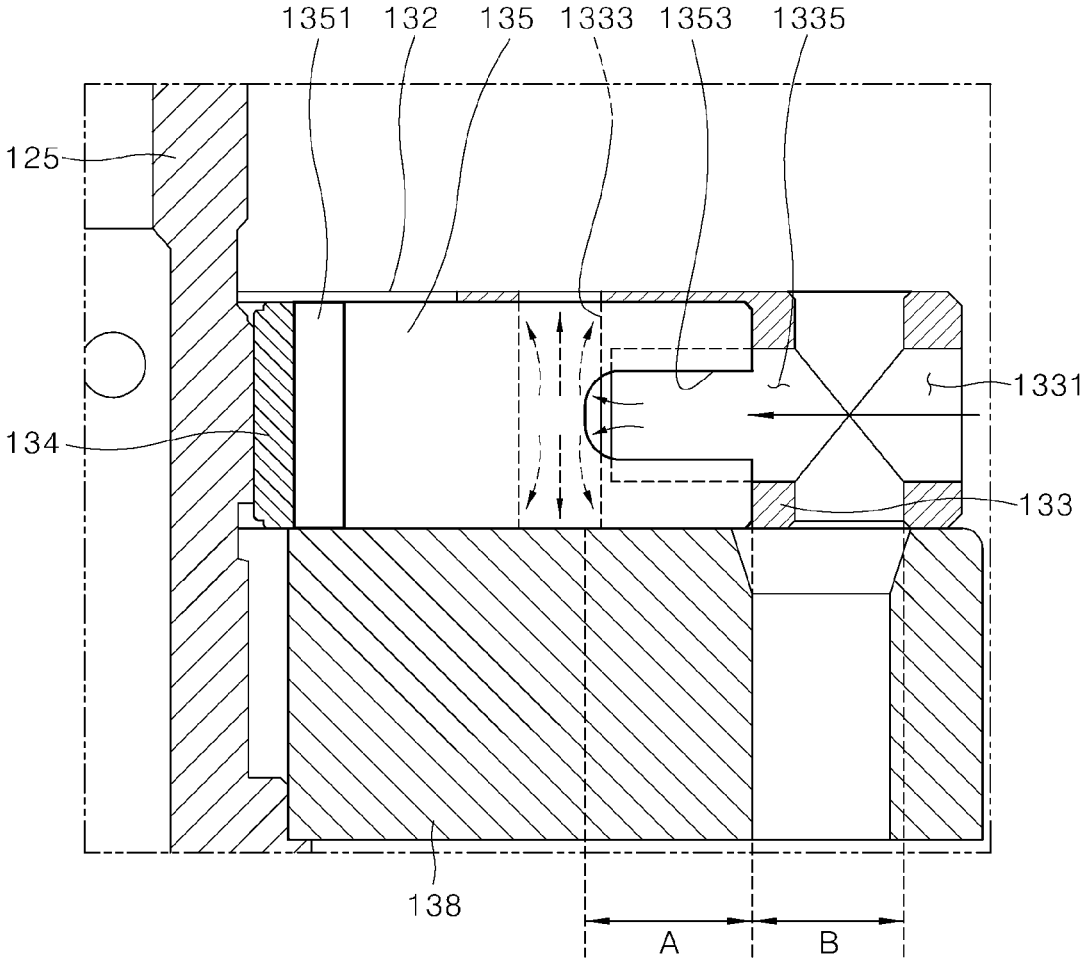
FIG. 9 is a side-sectional view illustrating the position of the vane when the roller is located at the first point.

FIG. 6 is a horizontal-sectional view illustrating a position of each of a roller and a vane when the roller is located at a second point, and FIG. 7 is a side-sectional view illustrating the position of the vane when the roller is located at the second point. Further, FIG. 8 is a horizontal-sectional view illustrating a position of each of the roller and the vane when the roller is located at a first point, and FIG. 9 is a side-sectional view illustrating the position of the vane when the roller is located at the first point.

Hereinafter, the oil supply structure to the vane in the vane slot will be described with reference to FIGS. 4 to 9.

Referring to FIG. 4, the roller 134 may revolve in the first cylinder 131 while coming into contact with an inner circumferential surface of the first cylinder 131. The roller 134 may revolve between a first point P1 and a second point P2. Further, the vane 135 may linearly move in the vane slot 133 in conjunction with revolution of the roller 134.

Here, the first point P1 may be defined as a point farthest away from the vane slot 133 in the compression space in the first cylinder 131. Further, the second point P2 may be defined as a point closest to the vane slot 133 in the compression space in the first cylinder 131.

Accordingly, when the roller 134 is located at the first point P1, the vane 135 may come out of the vane slot 133 most. Further, when the roller 134 revolves in a direction from the first point P1 toward the second point P2, the vane 135 may linearly move in the insertion direction into the vane slot 133, that is, in the centrifugal direction.

Further, when the roller 134 is located at the second point P2, the vane 135 may be inserted into the vane slot 133 the deepest. In addition, when the roller 134 revolves in a direction from the second point P2 toward the first point P1, the vane 135 may linearly move in the escaping direction from the vane slot 133, that is, in the centripetal direction.

Referring to FIGS. 6 and 7, when the roller 134 is located at a position further biased to the second point P2, the open hole 1353 may be disposed at the second position B. Accordingly, the open hole 1353 is located at a position not overlapping the sidewall path 1333 in the circumferential direction, and the communication part blocks the space between the sidewall path 1333 and the second oil supply path 1335.

When the roller 134 is located at the second point P2, like the above, the refrigerant is compressed in the compression chamber S2 at a high level, and accordingly, a pressure of the compression space of the first cylinder 131 maintains a high level.

Further, the vane 135 which communicates with the roller 134 is also inserted into the vane slot 133 the deepest, and the communication part provided in the vane 135 blocks the space between the sidewall path 1333 and the second oil supply path 1335. As described above, since the pressure of the compression space increases and a path between the sidewall path 1333 and the second oil supply path 1335 is blocked, it becomes difficult for the oil to be introduced into the sidewall path 1333.

In this state, as shown in FIGS. 8 and 9, when the roller 134 revolves and moves to a position further biased to the first point P1, the open hole 1353 may be disposed at the first position A. Accordingly, the open hole 1353 is located at the position overlapping the sidewall path 1333 in the circumferential direction, and the communication part communicates between the sidewall path 1333 and the second oil supply path 1335.

Like the above, when the roller 134 is located at the first point P1, the refrigerant is smoothly suctioned into the suction chamber S1, and accordingly, the pressure of the compression space of the first cylinder 131 decreases.

Further, the vane 135 connected to the roller 134 also escapes from the vane slot 133 most, and the communication part provided in the vane 135 communicates between the sidewall path 1333 and the second oil supply path 1335. As described above, since the pressure of the compression space decreases, and the path between the sidewall path 1333 and the second oil supply path 1335 communicates, the oil may be introduced into the sidewall path 1333.

Specifically, due to a pressure difference between an outer space of the first cylinder 131 in a high-pressure state and the compression space in the first cylinder 131 in a relatively lower pressure, the oil which fills the outside of the first cylinder 131 may be introduced into the vane slot 133 and the second oil supply path 1335 formed in the vane slot 133 through the first oil supply path 1331. As described above, the oil introduced into the vane slot 133 and the second oil supply path 1335 may be introduced into the sidewall path 1333 through the open hole 1353 located at the first position A, and accordingly, the oil may be supplied to the sidewall path 1333.

[Action and Effect of Rotary Compressor]

The vane 135 linearly moves along a path formed in the vane slot 133 due to movement of the roller 134 which revolves in the first cylinder 131. The roller 134 revolves in the first cylinder 131 and thus transfers a force which acts in the circumferential direction of each of the cylinders 131 and 132 in addition to a force necessary for the linear movement of the vane 135 to the vane 135.

Accordingly, the vane 135 presses the inner wall of the first cylinder 131 facing the vane slot 133 while linearly moving. Accordingly, a friction resistance between the vane 135 and the inner wall of the first cylinder 131 increases, and thus, sliding loss increases, which may act as a cause of an increase of abrasion of the vane 135 and the inner wall of the first cylinder 131.

In the embodiment, the vane 135 is illustrated as being formed of an SUJ2 steel material. The SUJ2 steel is suitable as the material for manufacturing the vane 135 which should repeatedly move under the high pressure in the compression space.

Further, the SUJ2 has a characteristic that a thermal expansion coefficient is high. Accordingly, when the friction resistance between the vane 135 and the inner wall of the first cylinder 131 increases, and thus a temperature of the vane 135 rises, a volume of the vane 135 may easily increase.

Like the above, when the volume of the vane 135 increases, the friction resistance between the vane 135 and the inner wall of the first cylinder 131 may further increase. Accordingly, in order to decrease the friction resistance between the vane 135 and the inner wall of the first cylinder 131 which is generated while the vane 135 linearly moves, the temperature of the vane 135 has to be prevented from rising to a predetermined temperature or more.

In consideration of the above, in the embodiment, a structure of cooling the vane 135 in which the vane 135 is cooled by the oil introduced into the sidewall path 1333 provided on the vane slot 133 is disclosed.

Accordingly, when the first oil supply path 1331 and the second oil supply path 1335 are connected to and disconnected from the sidewall path 1333 and the second oil supply path 1335 and the sidewall path 1333 are connected to each other in conjunction with the linear movement of the vane 135, due to a pressure difference between the compression space in the first cylinder 131 and the outside of the first cylinder 131, the oil may be supplied to the sidewall path 1333.

As described above, the oil supplied to the sidewall path 1333 may be heat-exchanged with the vane 135 to perform cooling of the vane 135, and accordingly, since an increase of the temperature of the vane 135 is restrained, an increase of the volume of the vane 135 may be restrained.

Particularly, since the sidewall path 1333 is provided to correspond not to a portion of the vane 135 in the axial direction but to an entire region of the vane 135 in the axial direction, the oil supplied to the sidewall path 1333 may come into contact with the entire region of the vane 135 in the axial direction. Accordingly, cooling efficiency for the vane 135 may be further improved.

As described above, since the cooling efficiency for the vane 135 may be improved, the increase of the volume of the vane 135 may be effectively restrained. Accordingly, the rotary compressor of the embodiment may provide an effect that sliding loss due to the friction between the vane 135 and the inner wall of the cylinder 131 or 132 decreases, and thus more improved performance can be provided and the lifespan of each of the vane 135 and the cylinder 131 or 132 can be lengthened by effectively reducing an abrasion degree of the vane 135 and the inner wall of the cylinder 131 or 132.

Meanwhile, in the embodiment, although the structures and actions of the cylinder 131 or 132 and related peripheral components have been described with components of the first cylinder 131 as examples, the present disclosure is not limited thereto. The above-described components may be identically applied to the second cylinder 132 as well as the first cylinder 131, and those skilled in the art may easily apply the components applied to the first cylinder 131 to the second cylinder 132.

[Second Embodiment of Rotary Compressor]

Figure 10:
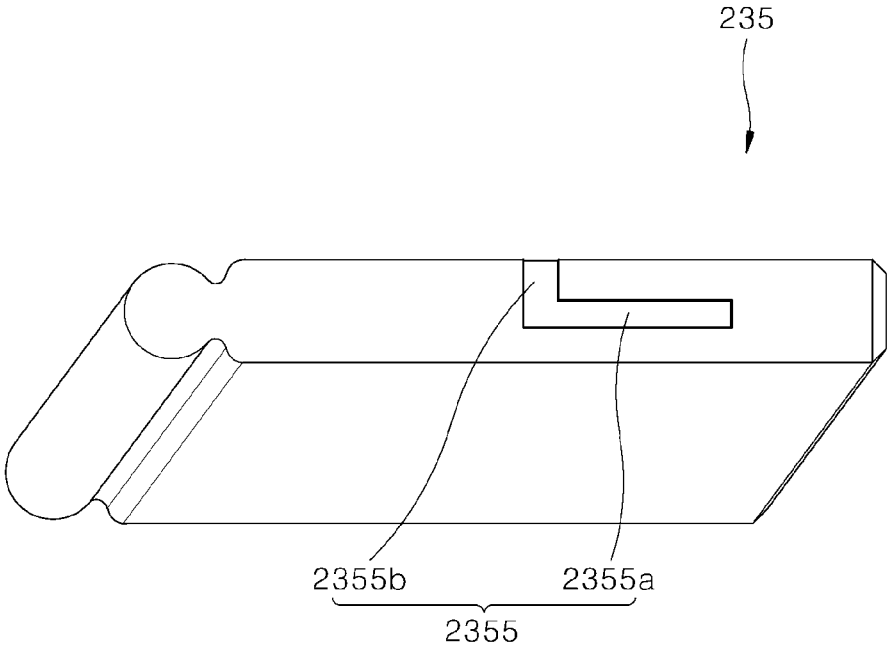
FIG. 10 is a perspective view illustrating a vane provided in a separated state in a rotary compressor according to a second embodiment of the present disclosure.
Figure 11:
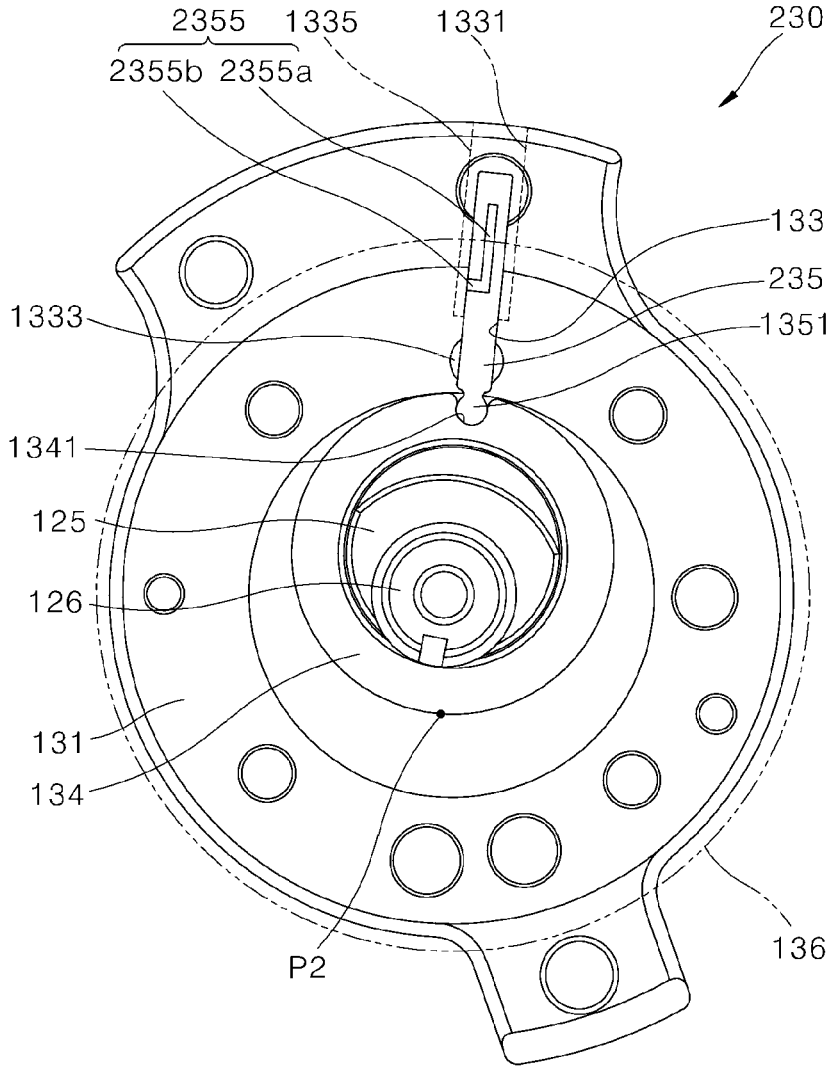
FIG. 11 is a plan view illustrating a position of a vane when a roller is located at a second point.

FIG. 10 is a perspective view illustrating a vane provided in a separated state in a rotary compressor according to a second embodiment of the present disclosure, and FIG. 11 is a plan view illustrating a position of a vane when a roller is located at a second point.

Referring to FIGS. 10 and 11, a compression part 230 of the rotary compressor according to the second embodiment of the present disclosure includes a vane 235 provided with an oil supply groove 2355.

The oil supply groove 2355 serves as a communication part which selectively communicates between an outer space of a vane slot 133 filled with oil and a sidewall path 1333, and is provided on the vane 235.

The oil supply groove 2355 is concavely formed in the vane 235. In the embodiment, an example in which the oil supply groove 2355 is concavely formed in one side of the vane 235 in an axial direction, more specifically, an upper surface of the vane 235 facing a first member (for example, a first bearing), is described. The oil supply groove 2355 may be formed to a length which extends in a moving direction of the vane 235 and may include a first groove portion 2355*a* and a second groove portion 2355*b*.

The first groove portion 2355*a* may be concavely formed in the upper surface of the vane 235 facing the first member. The first groove portion 2355*a* may extend along the moving direction of the vane 235, that is, a radial direction. That is, the first groove portion 2355*a* may be disposed at a center of the vane 235 in a circumferential direction and may be formed in a groove shape concavely formed in the upper surface of the vane 235 and having a length which extends in the radial direction.

Like the first groove portion 2355*a*, the second groove portion 2355*b* may be concavely formed in the upper surface of the vane 235 facing the first member. The second groove portion 2355*b* may be formed in a groove shape which extends from the first groove portion 2355*a* in the circumferential direction. The second groove portion 2355*b* formed as described above may be opened toward an inner wall of a first cylinder 131 facing the vane 235. That is, the second groove portion 2355*b* may be formed in a groove shape of which one side is connected to the first groove portion 2355*a* and the other side is opened toward the inner wall of the first cylinder 131.

A position of the oil supply groove 2355 may be changed according to a position of the vane 235. That is, when the vane 235 moves in an escaping direction from the vane slot 133, that is, in a centripetal direction, the position of the oil supply groove 2355 is also changed in the centripetal direction as much as a moving distance of the vane 235. Further, when the vane 235 moves in an insertion direction into the vane slot 133, that is, in a centrifugal direction, the position of the oil supply groove 2355 is also changed in the centrifugal direction as much as a moving distance of the vane 235.

When the oil supply groove 2355 is located at a first position A, the second groove portion 2355*b* of the oil supply groove 2355 is located at a position overlapping the sidewall path 1333 in the circumferential direction. Further, the oil supply groove 2355 including the first groove portion 2355*a* and the second groove portion 2355*b* is entirely disposed at inner sides of the first member and a second member in the circumferential direction, that is, the inner sides of a first bearing 136 and a middle plate (138, see FIG. 2) in the circumferential direction.

The oil supply groove 2355 in this position may communicate with the sidewall path 1333 and not communicate with an outer space of the first cylinder 131 filled with oil.

Meanwhile, when the oil supply groove 2355 is located at a second position B, the second groove portion 2355*b* of the oil supply groove 2355 does not overlap the sidewall path 1333 in the circumferential direction. Further, at least a portion of the oil supply groove 2355, more specifically, a portion of the first groove portion 2355*a*, may be exposed to outer sides of the first member and the second member in the circumferential direction and, specifically, an outer side of the first bearing 136 which is the first member.

The oil supply groove 2355 in this position does not communicate with the sidewall path 1333 and communicates with only the outer space of the first cylinder 131 filled with oil.

Figure 12:
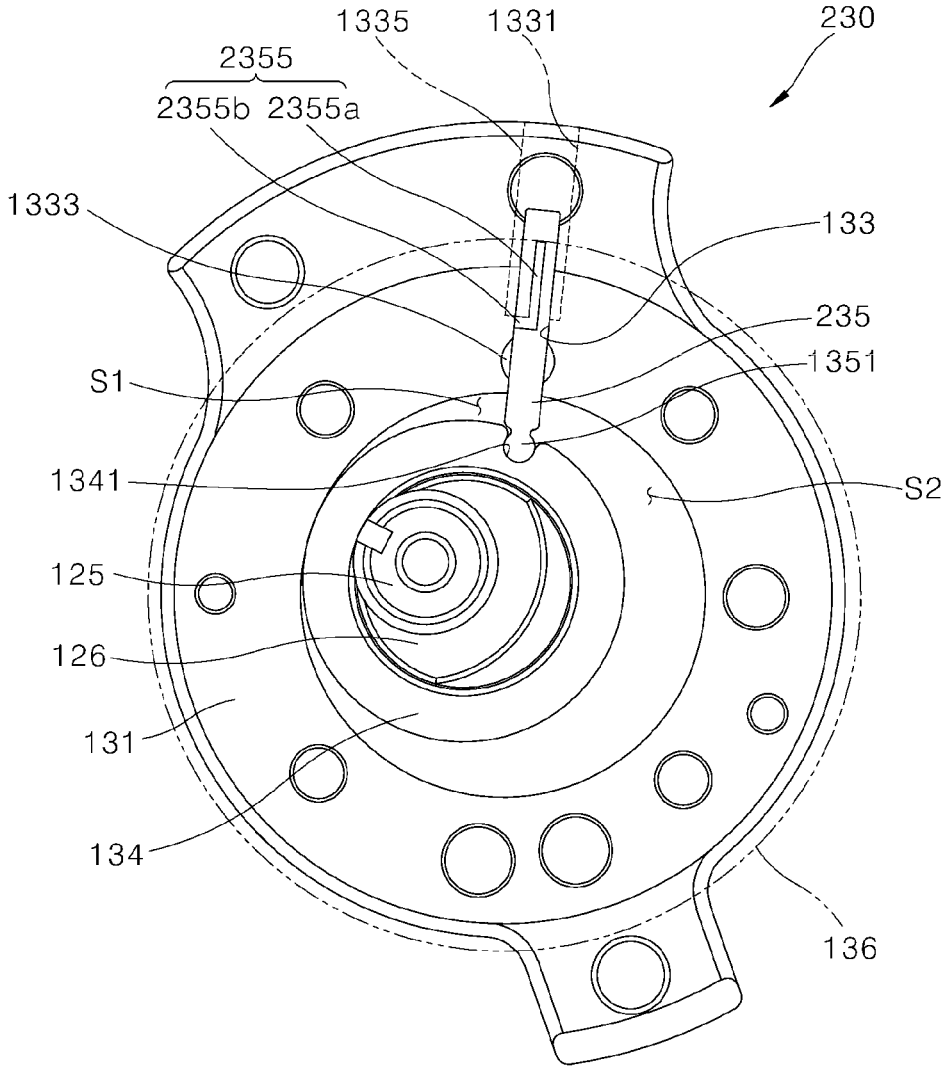
FIG. 12 is a plan view illustrating a position of the vane when the roller is located between the second point and a first point.
Figure 13:
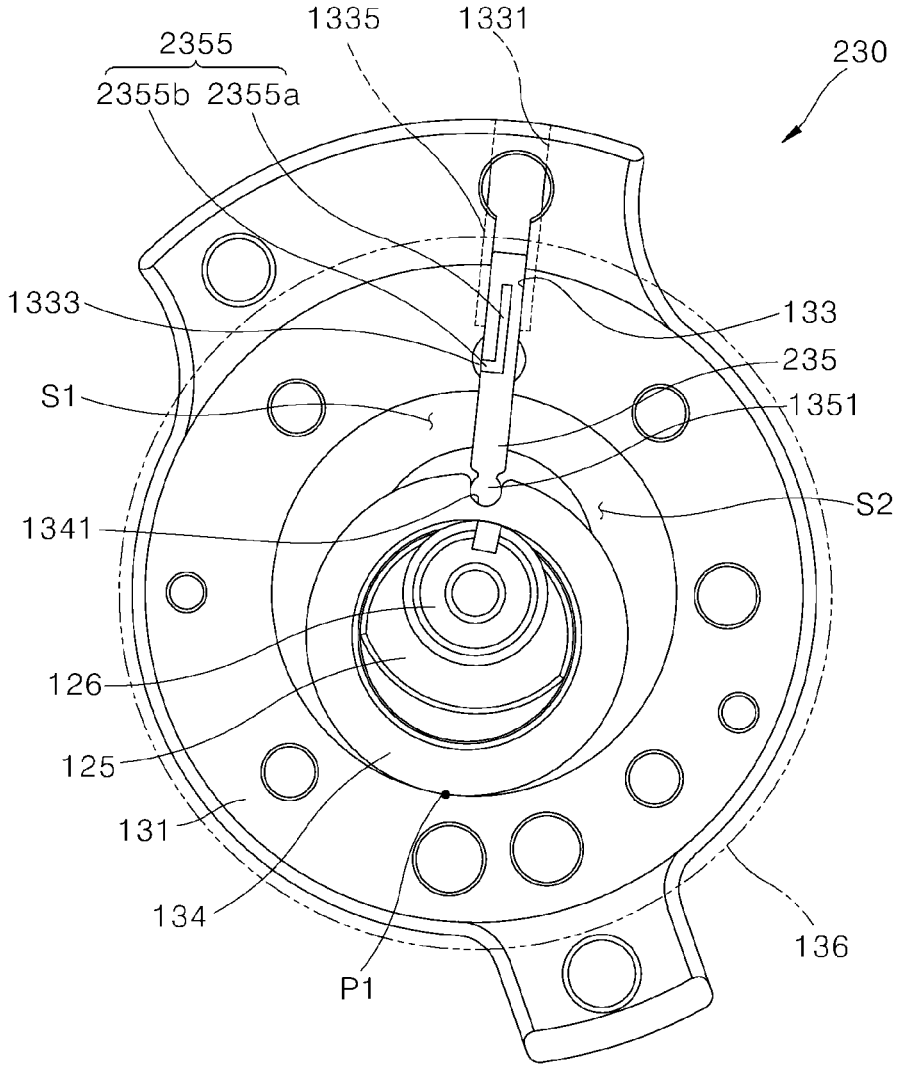
FIG. 13 is a plan view illustrating a position of the vane when the roller is located at the first point.

FIG. 12 is a plan view illustrating a position of the vane when the roller is located between a second point and a first point, and FIG. 13 is a plan view illustrating the position of the vane when the roller is located at the first point.

Hereinafter, the oil supply structure to the vane in the vane slot formed by the oil supply groove will be described with reference to FIGS. 10 to 13.

Referring to FIGS. 10 and 11, when the roller 134 is located at a position further biased to a second point P2, the oil supply groove 2355 may be disposed at a second position B. Accordingly, the oil supply groove 2355 does not communicate with the sidewall path 1333 and communicates with only the outer space of the first cylinder 131 filled with oil.

In this state, the oil which fills the outer space of the first cylinder 131 which is in a high-pressure state may be introduced into the oil supply groove 2355 through the first groove portion 2355*a* exposed to an outer side of the first bearing 136.

In this state, as shown in FIG. 12, when the roller 134 revolves and moves to a position between the second point P2 and the first point P1, the oil supply groove 2355 may be disposed at a position between the first position A and the second position B by the vane 235 which linearly moves along the roller 134. In this case, the oil supply groove 2355 moves to a position covered by the first bearing 136.

Accordingly, the oil supply groove 2355 may not communicate with both the outer space of the first cylinder 131 and the sidewall path 1333, and the oil which fills the oil supply groove 2355 may be carried to the inside of the first cylinder 131 by the vane 235.

As shown in FIG. 13, when the roller 134 revolves and moves to a position further biased to the first point P1, the oil supply groove 2355 may be disposed at the first position A by the vane 235 linearly moving along the roller 134.

As described above, when the oil supply groove 2355 is disposed at the first position A, the oil supply groove 2355 and the sidewall path 1333 may communicate with each other. Further, like the above, when the roller 134 is located at the first point P1, since the compression space of the first cylinder 131 is in a low-pressure state, the oil in the oil supply groove 2355 carried by the vane 235 may be smoothly supplied to the sidewall path 1333.

According to the rotary compressor of the embodiment having the above-described configuration, the oil supply groove 2355 may be formed through a process of slightly digging only a portion of a surface of the vane 235, and an oil supply structure for cooling the vane 235 may be effectively provided by the oil supply groove 2355 formed in this way.

That is, a process of largely deforming an original form of the vane 235 such as making an incision or the like is not necessary to form the oil supply structure for cooling the vane 235.

Accordingly, the rotary compressor in which costs consumed for processing of the vane 235 may be reduced, and the vane 235 having a greater strength is included may be provided.

[Third Embodiment of Rotary Compressor]

Figure 14:
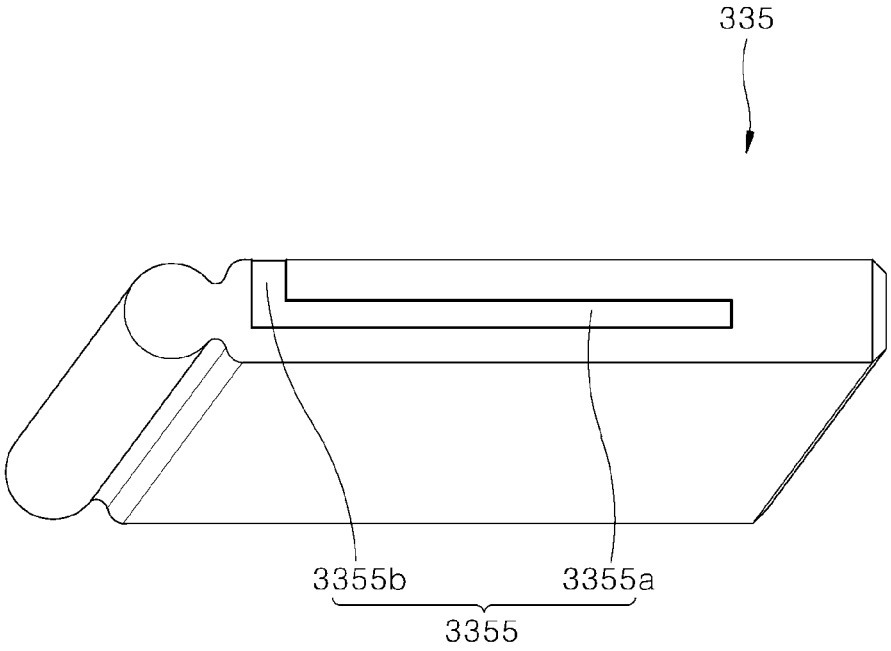
FIG. 14 is a perspective view illustrating a vane provided in a separated state in a rotary compressor according to a third embodiment of the present disclosure.
Figure 15:
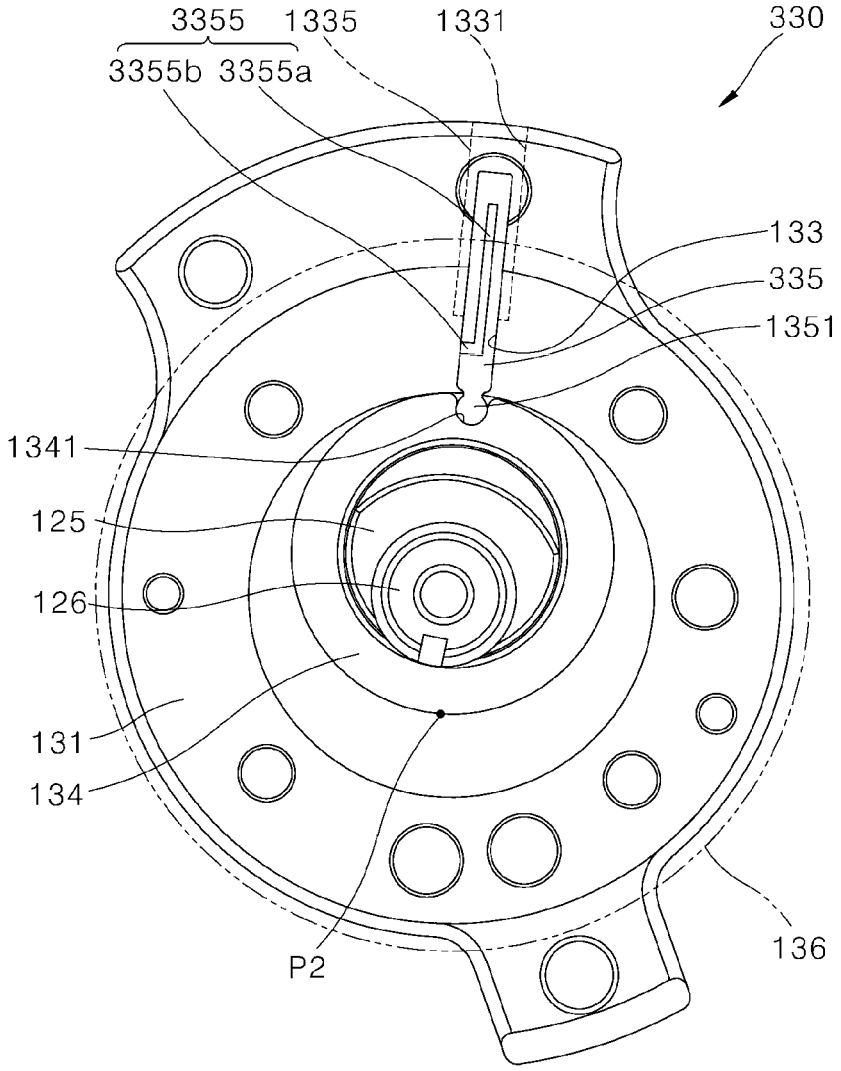
FIG. 15 is a plan view schematically illustrating components of the rotary compressor according to the third embodiment of the present disclosure.

FIG. 14 is a perspective view illustrating a vane provided in a separated state in a rotary compressor according to a third embodiment of the present disclosure, and FIG. 15 is a plan view schematically illustrating components of the rotary compressor according to the third embodiment of the present disclosure.

Referring to FIGS. 14 and 15, unlike the above-described embodiments, in a compression part 330 of the rotary compressor according to the third embodiment of the present disclosure, a cylinder is not provided with a sidewall path.

According to the embodiment, an oil supply groove 3355 provided in a vane 335 may be formed to have a relatively greater length in a radial direction than the oil supply groove exemplified in the above-described embodiment. As an example, a first groove portion 3355*a* of the oil supply groove 3355 may be formed to a length which further extends in a centripetal direction than the first groove portion exemplified in the above-described embodiment. Further, a second groove portion 3355*b* of the oil supply groove 3355 may be formed at a position further moved in the centripetal direction than the second groove portion exemplified in the above-described embodiment.

A position of the oil supply groove 3355 may be changed according to a position of the vane 335. When the oil supply groove 3355 is located at a first position A, the second groove portion 3355*b* of the oil supply groove 3355 may be exposed to a compression space of a first cylinder 131.

The oil supply groove 3355 in this position may communicate with the compression space in the first cylinder 131 and not communicate with an outer space of the first cylinder 131 filled with oil.

Meanwhile, when the oil supply groove 3355 is located at a second position B, the second groove portion 3355*b* of the oil supply groove 3355 is not exposed to the compression space in the first cylinder 131 and is located in a vane slot 133. Further, at least a portion of the oil supply groove 3355, more specifically, a portion of the first groove portion 3355*a*, may be exposed to outer sides of a first member and a second member in the circumferential direction, specifically, an outer side of a first bearing 136 which is the first member.

The oil supply groove 3355 in this position does not communicate with a sidewall path 1333 and communicates with only an outer space filled with oil.

Figure 16:
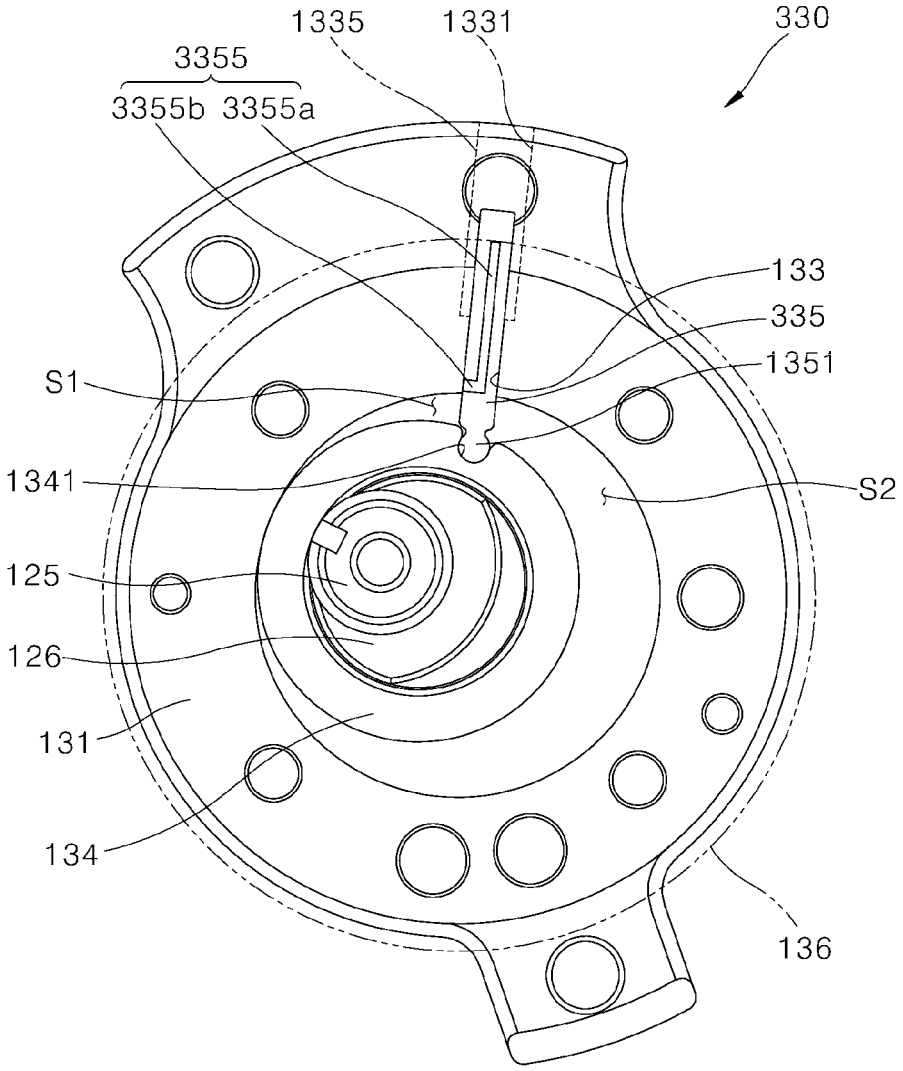
FIG. 16 is a plan view illustrating a position of a vane when a roller is located between a second point and a first point.
Figure 17:
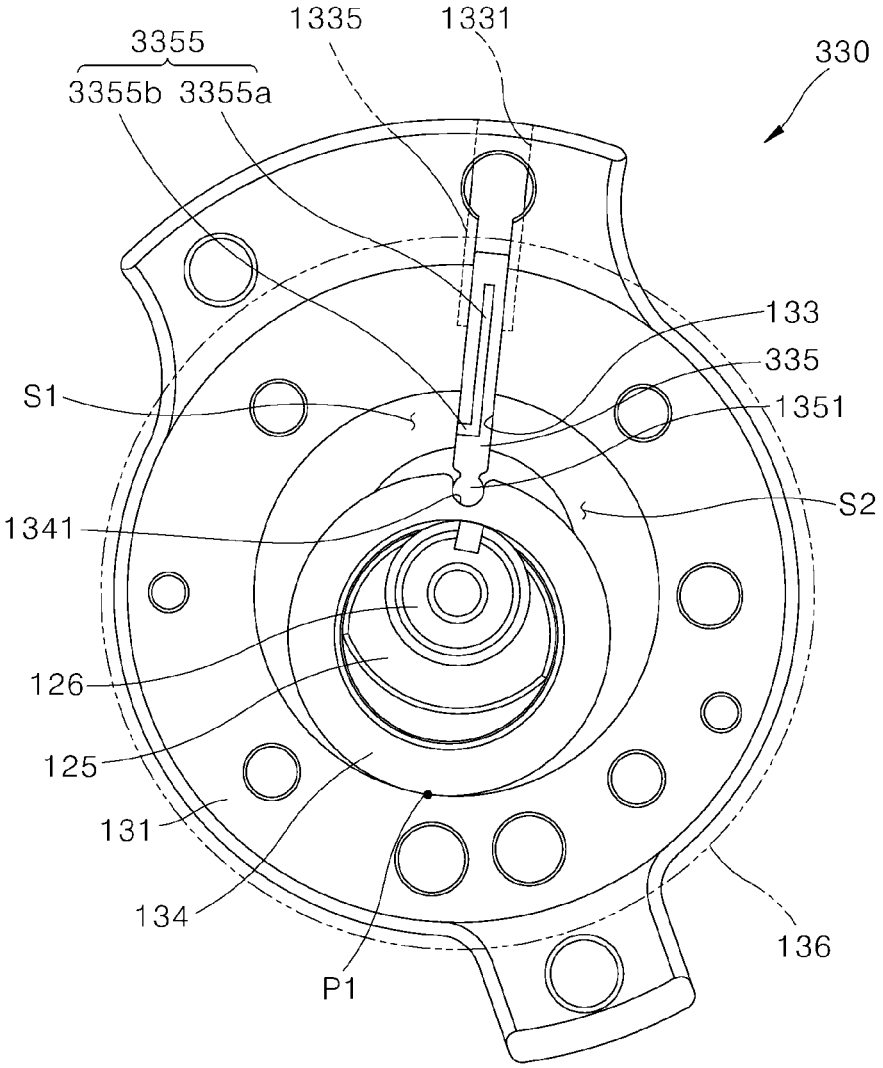
FIG. 17 is a plan view illustrating the position of the vane when the roller is located at the first point.

FIG. 16 is a plan view illustrating a position of the vane when a roller is located between a second point and a first point, and FIG. 17 is a plan view illustrating the position of the vane when the roller is located at the first point.

Hereinafter, an oil supply structure formed by the oil supply groove will be described with reference to FIGS. 14 to 17.

Referring to FIGS. 14 and 15, when a roller 134 is located at a position further biased to a second point P2, the oil supply groove 3355 may be disposed at the second position B. Accordingly, the oil supply groove 3355 does not communicate with the compression space in the first cylinder 131 and communicates with only the outer space of the first cylinder 131 filled with oil.

In this state, the oil which fills the outer space of the first cylinder 131 which is in a high-pressure state may be introduced into the oil supply groove 3355 through the first groove portion 3355*a* exposed to an outer side of a first bearing 136.

In this state, as shown in FIG. 16, when the roller 134 revolves and moves to a position between the second point P2 and the first point P1, the oil supply groove 3355 may be disposed at a position between the first position A and the second position B by the vane 335 which linearly moves along the roller 134. In this case, the oil supply groove 3355 moves to a position covered by the first bearing 136.

Accordingly, the oil supply groove 3355 may not communicate with both the outer space and the compression space of the first cylinder 131, and the oil which fills the oil supply groove 3355 may be carried to the inside of the first cylinder 131 by the vane 335.

As shown in FIG. 17, when the roller 134 revolves and moves to a position further biased to the first point P1, the oil supply groove 3355 may be disposed at the first position A by the vane 335 linearly moving along the roller 134.

As described above, when the oil supply groove 3355 is disposed at the first position A, the oil supply groove 3355 and the compression space in the first cylinder 131 may communicate with each other. Further, like the above, when the roller 134 is located at the first point P1, since the compression space of the first cylinder 131 is in a low-pressure state, the oil in the oil supply groove 3355 carried by the vane 235 may be smoothly supplied to the compression space in the first cylinder 131.

Like the above, since the oil is supplied to the compression space in the cylinder, an effect may be provided that an occurrence of abrasion of the roller 134 disposed in the compression space in the cylinder and the cylinder is restrained and a cooling effect of the components is obtained.

Further, like the above, the oil introduced through the oil supply groove 3355 may be supplied to a component which covers the cylinder such as the bearing, and accordingly, an effect of providing cooling and lubrication to the component such as the bearing may also be provided.

According to a rotary compressor of the present disclosure, since oil for cooling a vane is supplied to a side portion of the vane, cooling efficiency for the vane can be improved, and accordingly, thermal expansion of the vane can be efficiently suppressed.

Further, in the present disclosure, since sliding loss due to friction between the vane and an inner wall of a cylinder decreases, the further improved performance can be provided, and the lifespan of each of the vane and the cylinder can be lengthened by effectively lowering an abrasion degree of the vane and the inner wall of the cylinder.

In addition, in the present disclosure, since an oil supply structure for cooling the vane through a process of slightly digging only a portion of a surface of the vane is provided, a rotary compressor in which the thermal expansion of the vane is effectively restrained, costs consumed for processing of the vane are reduced, and a vane having a greater strength is included can be provided.

As described above, the present disclosure has been described with reference to embodiments shown in the drawings but these are only exemplary, and it may be understood by those skilled in the art that various modifications and other equivalents are possible therefrom. Accordingly, the technical scope of the present disclosure should be determined by the technical spirit of the appended claims.

What is claimed is:

1. A rotary compressor comprising:

a cylinder including a compression space;

a roller configured to compress a refrigerant in the cylinder;

a vane engaged with the roller;

a vane slot defined at the cylinder, wherein the vane is at least partially inserted into the vane slot and linearly movable along the vane slot; and a sidewall path defined at an inner wall of the cylinder that faces the vane slot, the sidewall path facing a surface of the vane that is inserted into the vane slot, wherein:

the vane includes a communication part configured to, based on a position of the vane relative to the vane slot, selectively permit fluidic communication between (1) the vane slot and an oil space that receives oil or (2) between the compression space and the oil space, the communication part selectively permits fluidic communication between the oil space and the sidewall path, the vane has a proximal end and a distal end opposite to the proximal end in a radial direction, the vane having opposite sides extending between the proximal end and the distal end, the communication part includes a hole that extends through the vane between the opposite sides of the vane and extends from the distal end of the vane toward the proximal end of the vane in the radial direction, and the hole is open toward the inner wall of the cylinder that faces the vane the communication part fluidly communicates with the sidewall path and the vane slot based on the vane being located at a first vane position in which the hole overlaps the sidewall path and the vane slot, the communication part blocks the sidewall path from the vane slot based on the vane being located at a second vane position in which the hole is spaced apart from the sidewall path, the cylinder includes a first oil supply path configured to fluidly communicate with the oil space;

the cylinder includes a second oil supply path that fluidly communicates with the first oil supply path, the second oil supply path is defined at the vane slot and extends from the first oil supply path in a centripetal direction, and the second oil supply path and the first oil supply path are separated by the vane slot.

2. The rotary compressor of claim 1, wherein:

the first oil supply path extends through the cylinder and fluidly communicates with the vane slot in the cylinder.

3. The rotary compressor of claim 2, wherein the sidewall path is recessed at the inner wall of the cylinder so that a space is defined between the vane and the inner wall of the cylinder that faces the vane.

4. The rotary compressor of claim 3, wherein the sidewall path extends in an axial direction.

5. The rotary compressor of claim 3, wherein the sidewall path extends through the cylinder in an axial direction.

6. The rotary compressor of claim 5, further comprising:

a first member that covers a first side of the cylinder in the axial direction, and a second member that covers a second side of the cylinder that is opposite to the first side in the axial direction, wherein the sidewall path overlaps with the first member and the second member in the axial direction.

7. The rotary compressor of claim 6, wherein:

the first member includes a first bearing that covers the first side of the cylinder; and the second member includes a second bearing or a middle plate that covers the second side of the cylinder.

8. The rotary compressor of claim 6, wherein:

the first member includes a middle plate that covers the first side of the cylinder; and the second member includes a second bearing that covers the second side of the cylinder.

9. The rotary compressor of claim 1, wherein:

the communication part fluidly communicates with the sidewall path and the second oil supply path based on the vane being located at the first vane position; and the communication part blocks the sidewall path from the second oil supply path based on the vane being located at the second vane position.

10. The rotary compressor of claim 1, wherein:

the roller is configured to revolve between a first roller position and a second roller position, the second roller position being closer to the vane slot than the first roller position;

the vane is configured to linearly move in the vane slot based on revolution of the roller;

the vane is disposed at the first vane position based on the roller being located at a position that is closer to the first roller position than the second roller position; and the vane is disposed at the second vane position based on the roller being located at a position that is closer to the second roller position than the first roller position.

11. The rotary compressor of claim 1, wherein the vane is configured to define a suction chamber and a compression chamber in the compression space.

* * * * *